US009491817B2

(12) United States Patent
Wang

(10) Patent No.: US 9,491,817 B2
(45) Date of Patent: Nov. 8, 2016

(54) LED DRIVING CIRCUIT

(71) Applicant: Silergy Semiconductor Technology (Hangzhou) LTD, Hangzhou, ZheJiang Province (CN)

(72) Inventor: Zhaofeng Wang, Hangzhou (CN)

(73) Assignee: Silergy Semiconductor Technology (Hangzhou) LTD, Hangzhou (CN)

( * ) Notice: Subject to any disclaimer, the term of this patent is extended or adjusted under 35 U.S.C. 154(b) by 0 days.

(21) Appl. No.: 15/060,762

(22) Filed: Mar. 4, 2016

(65) Prior Publication Data

US 2016/0295648 A1 Oct. 6, 2016

(30) Foreign Application Priority Data

Mar. 31, 2015 (CN) ..... 2015 1 0148552

(51) Int. Cl.
*H05B 33/08* (2006.01)

(52) U.S. Cl.
CPC ..... *H05B 33/0812* (2013.01); *H05B 33/0845* (2013.01)

(58) Field of Classification Search
CPC ..... H05B 33/0815; H05B 33/0812; H05B 33/0833; H05B 33/0845; H05B 33/0851; H05B 33/0848; H05B 37/02; H05B 37/029; H05B 41/28; Y02B 20/346; Y02B 20/347
USPC ..... 315/291, 294, 297, 307, 224, 312
See application file for complete search history.

(56) References Cited

U.S. PATENT DOCUMENTS

| | | | | |
|---|---|---|---|---|
| 8,390,214 | B2 * | 3/2013 | Van Laanen | H02M 1/4225 315/294 |
| 8,773,041 | B2 | 7/2014 | Chen | |
| 8,803,439 | B2 * | 8/2014 | Stamm | H05B 33/0815 315/291 |
| 9,018,849 | B2 | 4/2015 | Han et al. | |
| 9,024,542 | B2 | 5/2015 | Chen | |
| 9,107,270 | B2 | 8/2015 | Chen | |
| 2007/0228994 | A1 | 10/2007 | Hung et al. | |
| 2013/0002159 | A1 | 1/2013 | Chen et al. | |

* cited by examiner

*Primary Examiner* — Haissa Philogene
(74) *Attorney, Agent, or Firm* — Michael C. Stephens, Jr.

(57) ABSTRACT

In one embodiment an LED driving circuit can include: (i) a rectifier circuit configured to receive an AC input power supply through a TRIAC, and to generate a bus voltage; (ii) a driving current generator configured to convert the bus voltage to a constant driving current and an output voltage to drive an LED load; and (iii) a current distribution circuit coupled between a positive pole and a negative pole of the bus voltage, where the current distribution circuit is configured to sample an input current to generate a sense signal, and to compare the sense signal against a voltage reference signal that represents an expected input current, so as to regulate the input current according to the voltage reference signal.

9 Claims, 7 Drawing Sheets

LED DRIVING CIRCUIT

RELATED APPLICATIONS

This application claims the benefit of Chinese Patent Application No. 201510148552.1, filed on Mar. 31, 2015, which is incorporated herein by reference in its entirety.

FIELD OF THE INVENTION

The present disclosure generally relates to the field of power electronics, and more particularly to an LED driving circuit.

BACKGROUND

A light-emitting diode (LED) driver is an electrical device that regulates the power to one or more LEDs. An LED driver may provide a constant quantity of power to the LED, and can include a power supply with outputs that are matched to the electrical characteristics of the LED(s). LED drivers may offer dimming by utilizing pulse-width modulation (PWM) circuits, and may have more than one channel for separate control of different LEDs. The power level of the LED can be maintained as substantially constant by the LED driver.

SUMMARY

In one embodiment an LED driving circuit can include: (i) a rectifier circuit configured to receive an AC input power supply through a tri-electrode AC switch (TRIAC), and to generate a bus voltage; (ii) a driving current generator configured to convert the bus voltage to a constant driving current and an output voltage to drive an LED load; and (iii) a current distribution circuit coupled between a positive pole and a negative pole of the bus voltage, where the current distribution circuit is configured to sample an input current to generate a sense signal, and to compare the sense signal against a voltage reference signal that represents an expected input current, so as to regulate the input current according to the voltage reference signal.

In one embodiment an LED driving circuit can include: (i) a rectifier circuit configured to receive an AC input power supply through a TRIAC, and to generate a bus voltage; (ii) a driving current generator configured to convert the bus voltage to a constant driving current and an output voltage to drive an LED load; and (iii) a current distribution circuit being coupled between a positive pole and a negative pole of the bus voltage, where the current distribution circuit is configured to sample a current flowing through the current distribution circuit to generate a sense signal, and to compare the sense signal against a voltage reference signal that represents an expected current flowing through the current distribution circuit, so as to regulate an input current according to the voltage reference signal.

DETAILED DESCRIPTION

Reference may now be made in detail to particular embodiments of the invention, examples of which are illustrated in the accompanying drawings. While the invention may be described in conjunction with the preferred embodiments, it may be understood that they are not intended to limit the invention to these embodiments. On the contrary, the invention is intended to cover alternatives, modifications and equivalents that may be included within the spirit and scope of the invention as defined by the appended claims. Furthermore, in the following detailed description of the present invention, numerous specific details are set forth in order to provide a thorough understanding of the present invention. However, it may be readily apparent to one skilled in the art that the present invention may be practiced without these specific details. In other instances, well-known methods, procedures, processes, components, structures, and circuits have not been described in detail so as not to unnecessarily obscure aspects of the present invention.

Figure 1:
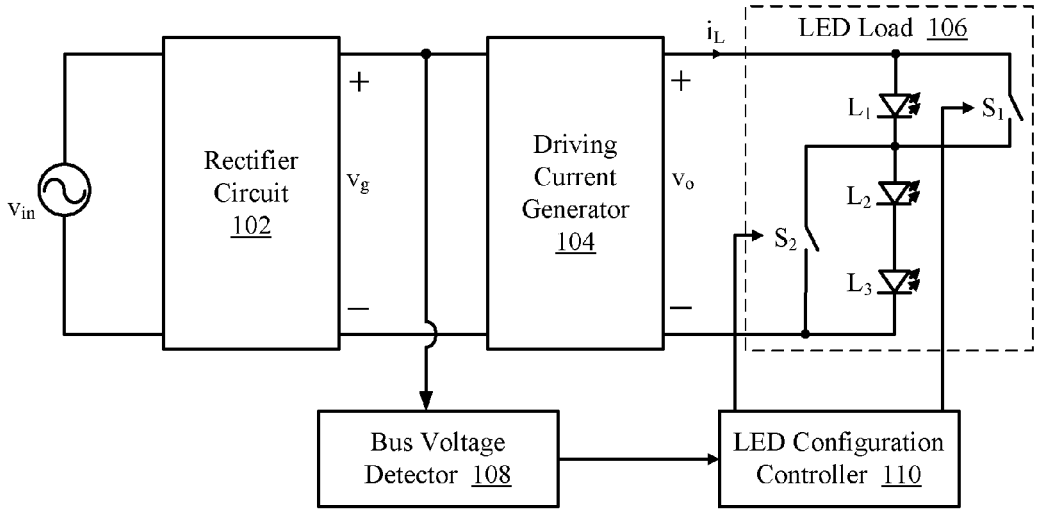
FIG. 1 is a schematic block diagram of an example LED driver.

Referring now to FIG. 1, shown is a schematic block diagram of an example LED driver. This example LED driver can include an AC power supply, rectifier circuit 102, and driving current generator 104. Rectifier circuit 102 can receive and rectify AC input voltage $V_{in}$ to generate DC voltage $V_g$. Driving current generator 104 can receive DC voltage $V_g$, and may generate output voltage $V_o$ and constant current $i_L$ for LED load 106. To reduce power loss, bus voltage detector 108 can detect bus voltage $V_g$, and LED configuration controller 110 may be utilized to turn on corresponding LEDs according to the bus voltage. However, though constant current $i_L$ in the LED driver can drive LED load 106, it may be unable to provide a latching current and a holding current required for turning on a TRIAC, as well as may be unable to regulate the input current in a dimming system. In this particular LED load 106, $L_1$, $L_2$ and $L_3$ can be LED lights, and $S_1$ and $S_2$ can be switches for controlling corresponding LED arrays. Also, the number of LED lights and switches can be changed according to various applications.

In one embodiment an LED driving circuit can include: (i) a rectifier circuit configured to receive an AC input power supply through a tri-electrode AC switch (TRIAC), and to generate a bus voltage; (ii) a driving current generator configured to convert the bus voltage to a constant driving current and an output voltage to drive an LED load; and (iii) a current distribution circuit coupled between a positive pole and a negative pole of the bus voltage, where the current distribution circuit is configured to sample an input current to generate a sense signal, and to compare the sense signal against a voltage reference signal that represents an expected input current, so as to regulate the input current according to the voltage reference signal.

Figure 2:
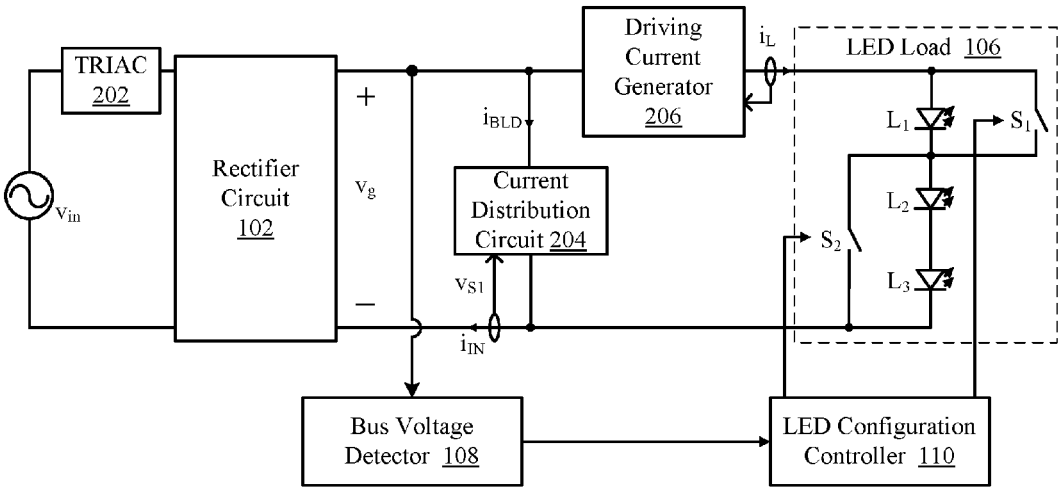
FIG. 2 is a schematic block diagram of a first example LED driving circuit, in accordance with embodiments of the present invention.

Referring now to FIG. 2, shown is a schematic block diagram of a first example LED driving circuit, in accordance with embodiments of the present invention. This particular example LED driving circuit can include an AC input power supply, tri-electrode AC switch TRIAC 202, rectifier circuit 102, and driving current generator 206. AC input voltage $V_{in}$ can be supplied to rectifier circuit 102 through TRIAC 202. Rectifier circuit 102 can generate DC voltage $V_g$ for driving current generator 206, and DC voltage $V_g$ can be converted to a constant driving current $i_L$ and output voltage $V_o$ for driving LED load 106.

The driving control circuit also can include current distribution circuit 204, which can connect between the positive and negative poles of the bus voltage in order to sample input current $i_{IN}$ to generate sense signal $V_{S1}$. Sense signal $V_{S1}$ and voltage reference signal $V_{R1}$ (e.g., that represents an expected input current) can be compared and amplified, in order to regulate input current $i_{IN}$. Driving current generator 206 can sample current $i_L$ that flows through LED load 106, and can maintain the output current as substantially constant via feedback control.

Figure 3:
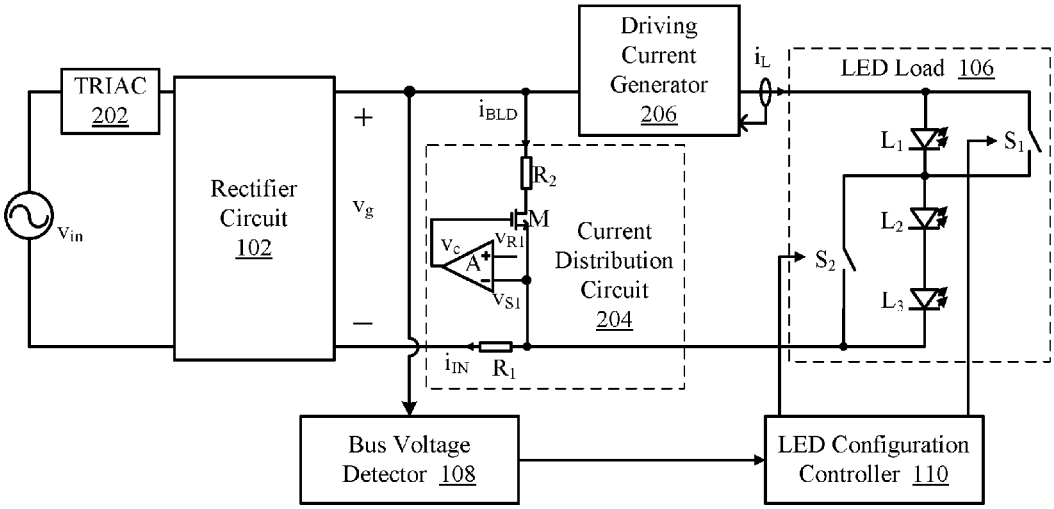
FIG. 3 is a schematic block diagram of an example current distribution circuit, in accordance with embodiments of the present invention.

Referring now to FIG. 3, shown is a schematic block diagram of an example current distribution circuit 204, in accordance with embodiments of the present invention. In this example, current distribution circuit 204 can include power transistor M, operational amplifier A, and sampling resistor $R_1$. Sense signal $V_{S1}$ can be obtained by sampling input current $i_{IN}$ through sampling resistor $R_1$. Operational amplifier A can receive sense signal $V_{S1}$ and voltage reference signal $V_{R1}$ at two input terminals, and may generate output current control signal $V_c$ for a control terminal of power transistor M. This can control current $i_{BLD}$ that flows through power transistor M, so as to keep input current $i_{IN}$ consistent with (e.g., substantially the same as) voltage reference signal $V_{R1}$. The first power terminal of power transistor M can connect to the positive pole of the bus voltage, and the second power terminal can connect to sampling resistor $R_1$.

The current flowing through power transistor M can be current $i_{BLD}$ flowing through current distribution circuit 204, and maybe controlled according to sampling signal $V_{S1}$ and voltage reference signal $V_{R1}$. For example, power transistor M can be operated in a linear current limiting mode. Because the sum of current $i_{BLD}$ flowing through power transistor M and driving current $i_L$ flowing through the load can equal input current $i_{IN}$, current distribution circuit 204 can maintain input current $i_{IN}$ as changing along with voltage reference signal $V_{R1}$. Thus, input current $i_{IN}$ remain constant when voltage reference signal $V_{R1}$ is unchanged.

Figure 4:
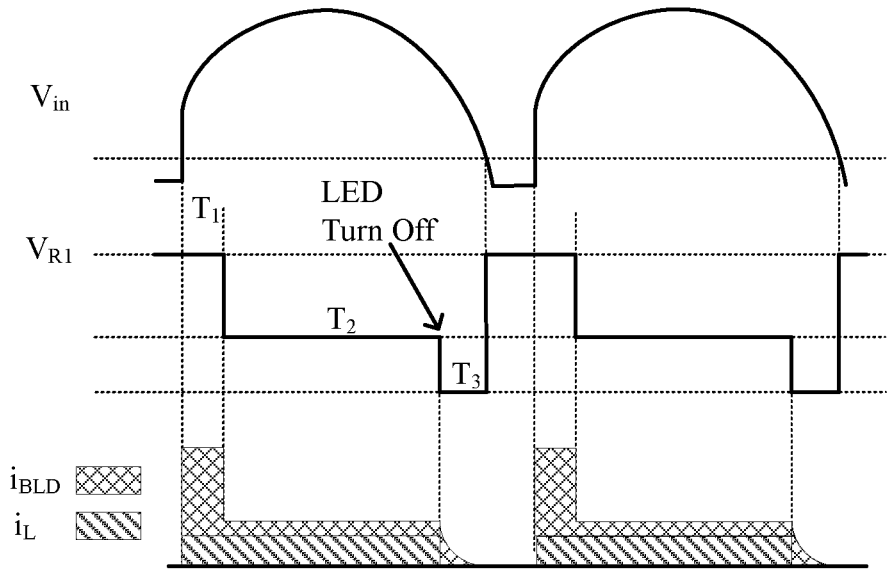
FIG. 4 is a waveform diagram of example operation of an LED driving circuit in one power frequency cycle, in accordance with embodiments of the present invention.

Referring now to FIG. 4, shown is a waveform diagram of example operation of an LED driving circuit in one power frequency cycle, in accordance with embodiments of the present invention. $V_{in}$ shows the input voltage in one power frequency cycle (including positive half cycle and negative half cycle) obtained after being rectified. Each of the half power frequency cycle can include TRIAC ignition time $T_1$, holding time $T_2$, and discharging time $T_3$. Voltage reference signal $V_{R1}$ may be different in different time periods. In TRIAC ignition time $T_1$, voltage reference signal $V_{R1}$ can be consistent with a latching current of TRIAC 202, so voltage reference signal $V_{R1}$ can be relatively large due to the larger latching current during this time period.

In holding time $T_2$, voltage reference signal $V_{R1}$ can be consistent with the holding current, so voltage reference signal $V_{R1}$ can be lower than in TRIAC ignition time $T_1$ because the holding current is smaller than the latching current. In discharging time $T_3$, voltage reference signal $V_{R1}$ can be consistent with the discharging current, which may be relatively small. Discharging time $T_3$ can be used to avoid interference, such that voltage $V_{in}$ can be compared with threshold voltage $V_{th}$ in the next half cycle. The sum of current $i_{BLD}$ flowing through power transistor M and driving current $i_L$ flowing through the load can be equal to input current $i_{IN}$. As shown in FIG. 4, voltage reference signal $V_{R1}$ almost changes along with the sum of current $i_{BLD}$ and current $i_L$.

Figure 5:
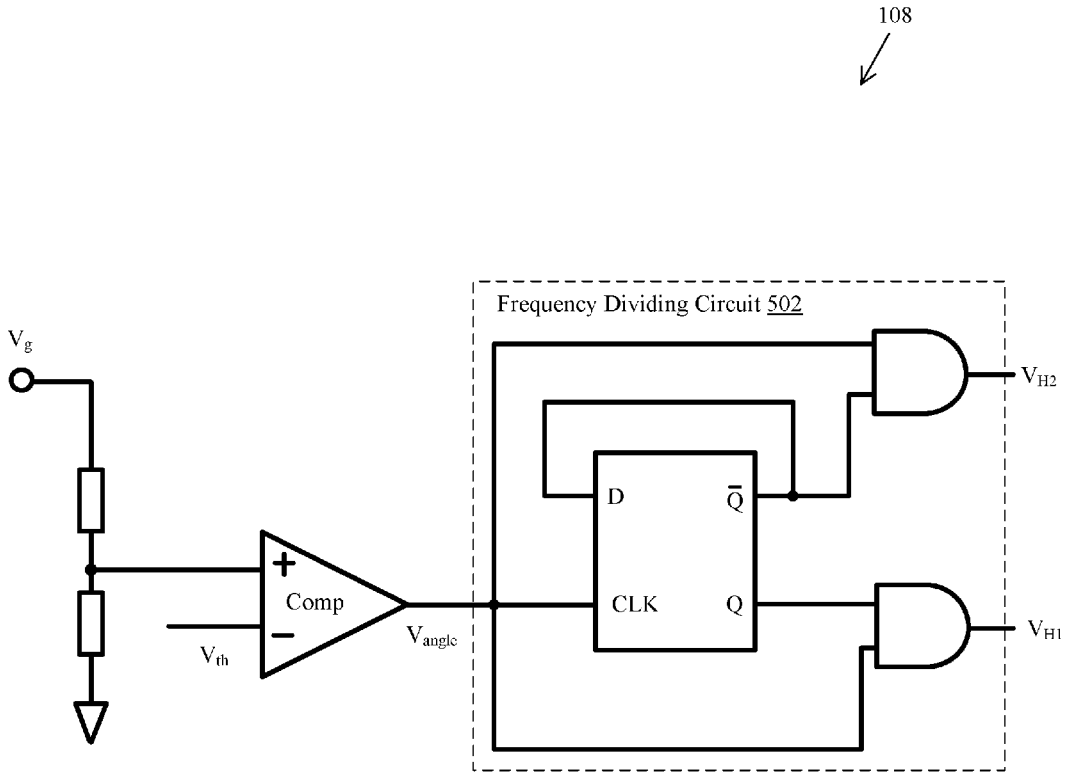
FIG. 5 is a schematic block diagram of an example bus voltage detector, in accordance with embodiments of the present invention.

Referring now to FIG. 5, shown is a schematic block diagram of an example bus voltage detector, in accordance with embodiments of the present invention. This example bus voltage detector 108 can sample bus voltage $V_g$ via a voltage bleeder, and may compare with threshold voltage $V_{th}$ via comparator Comp, in order to obtain conduction angle signal $V_{angle}$ that represents a conduction angle of the TRIAC. Clock signal $V_{H1}$ that represents the positive half cycle, and clock signal $V_{H2}$ that represents the negative half cycle can be obtained from conduction angle signal $V_{angle}$ via frequency dividing circuit 502. Frequency dividing circuit 502 can be configured to make the positive half cycle equal to the negative half cycle of conduction angle signal $V_{angle}$ by delaying the rising edge and/or advancing the falling edge.

For example, the positive half cycle and the negative half cycle of conduction angle $V_{angle}$ can be respectively calculated. If the positive half cycle is larger than the negative half cycle, by delaying the rising edge or advancing the falling edge of the positive half cycle, the positive half cycle can be regulated to be equal to the negative half cycle. If the positive half cycle is smaller than the negative half cycle, by delaying the rising edge or advancing the falling edge of the negative half cycle, the positive half cycle will be regulated to be equal to the negative half cycle. It should be noted that FIG. 5 only shows a portion of bus voltage detector 108 instead of all components for the sake of clarity.

Figure 6:
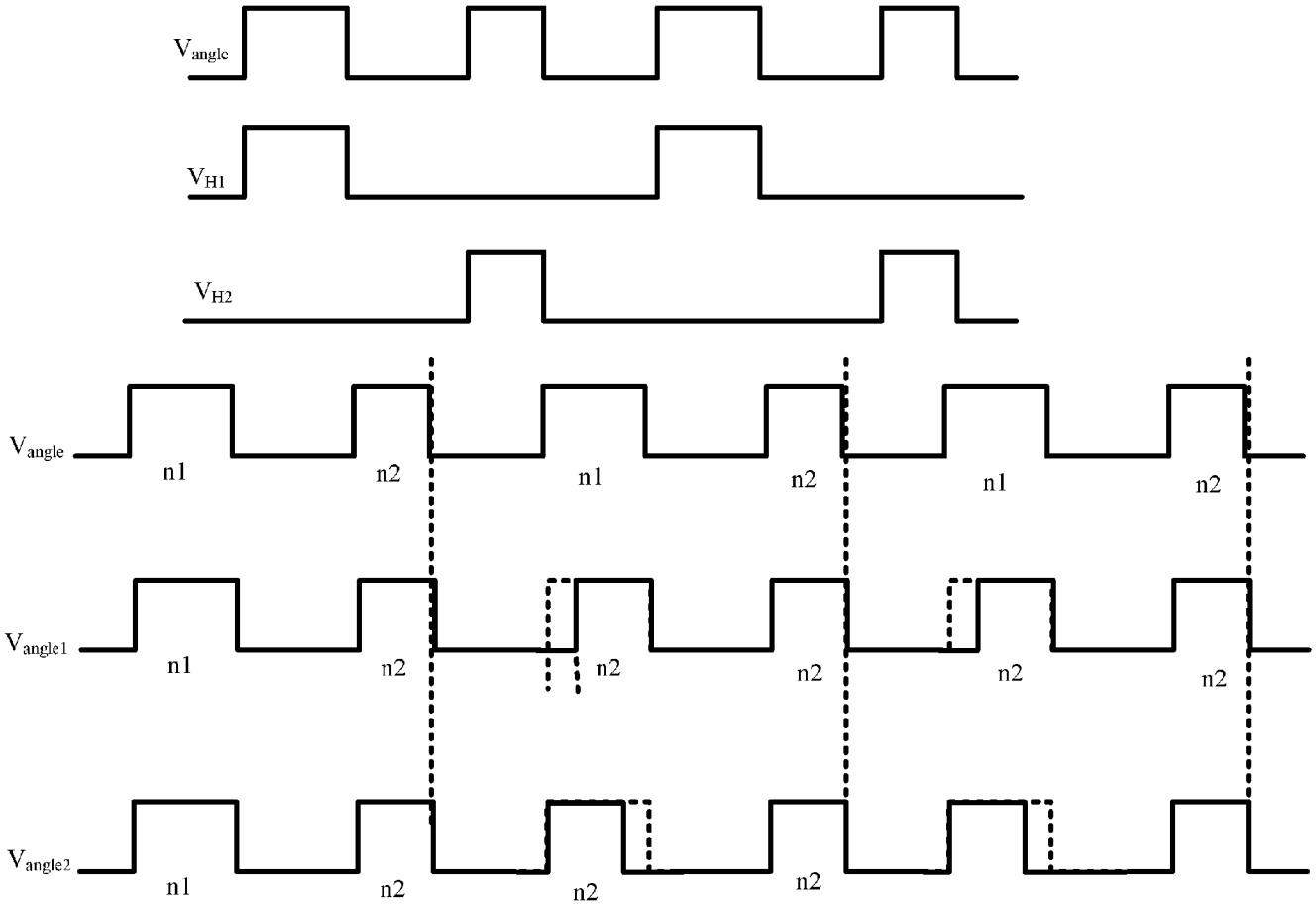
FIG. 6 is a waveform diagram of the bus voltage detector in FIG. 5, in accordance with embodiments of the present invention.

Referring now to FIG. 6, shown is a waveform diagram of the bus voltage detector 108 in FIG. 5, in accordance with embodiments of the present invention. This particular example can include conduction angle signal $V_{angle}$, clock signal $V_{H1}$, and clock signal $V_{H2}$. As shown, the positive half cycle and the negative half cycle of conduction angle signal $V_{angle}$ may be inconsistent, so frequency dividing circuit 502 can be utilized to obtain clock signal $V_{H1}$ and clock signal $V_{H2}$. Also shown are two examples for processing the conduction angle signal, where $V_{angle1}$ is obtained by delaying the rising edge of the positive half cycle of conduction angle signal $V_{angle}$, and $V_{angle2}$ is obtained by advancing the falling edge of the positive half cycle of conduction angle signal $V_{angle}$, so as to keep the positive half cycle and the negative half cycle consistent with each other.

In one embodiment an LED driving circuit can include: (i) a rectifier circuit configured to receive an AC input power supply through a TRIAC, and to generate a bus voltage; (ii) a driving current generator configured to convert the bus voltage to a constant driving current and an output voltage to drive an LED load; and (iii) a current distribution circuit being coupled between a positive pole and a negative pole of the bus voltage, where the current distribution circuit is configured to sample a current flowing through the current distribution circuit to generate a sense signal, and to compare the sense signal against a voltage reference signal that represents an expected current flowing through the current distribution circuit, so as to regulate an input current according to the voltage reference signal.

Figure 7:
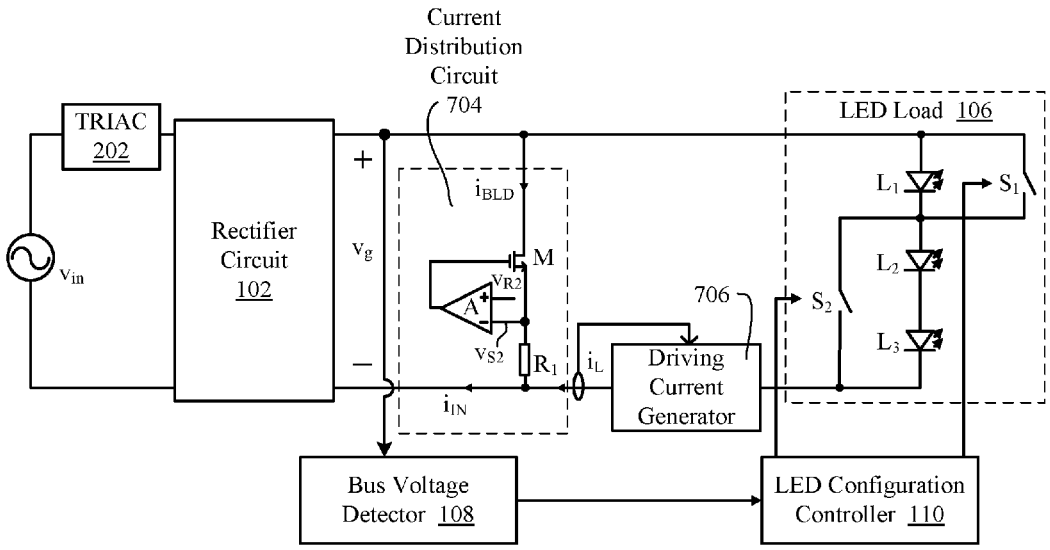
FIG. 7 is a schematic block diagram of a second example LED driving circuit, in accordance with embodiments of the present invention.

Referring now to FIG. 7, shown is a schematic block diagram of a second example LED driving circuit, in accordance with embodiments of the present invention. In this particular example, current distribution circuit 704 can include power transistor M, operational amplifier A, and sampling resistor $R_1$. Sense signal $V_{S2}$ can be obtained by sampling current $i_{BLD}$ flowing through current distribution circuit 704 via sampling resistor $R_1$. Operational amplifier A can receive sense signal $V_{S2}$ and voltage reference signal $V_{R2}$ at two input terminals, and may generate current control signal $V_C$ to provide to the control terminal of power transistor M, to further control the current flowing through the power transistor.

In this way, the current $i_{BLD}$ flowing through current distribution circuit 704 can be substantially consistent with (e.g., the same as) voltage reference signal $V_{R2}$. Voltage reference signal $V_{R2}$ may represent an expected current flowing through current distribution circuit 704, and can thereby determine the expected input current and maintain the driving current as constant. It should be noted that both the examples of FIGS. 3 and 7 can regulate the input current and maintain the corresponding latching current and holding current.

In addition, the output current of driving current generator 706 can be regulated according to the conduction angle signal. For example, when the conduction angle is large, the output current may be reduced, and when the conduction angle is small, the output current may be increased, thereby keeping the brightness of LED load 106 substantially stable. In this way, the LED driving circuit can be employed in TRIACs with different conduction angles to keep the brightness of LED load 106 substantially stable.

The embodiments were chosen and described in order to best explain the principles of the invention and its practical applications, to thereby enable others skilled in the art to best utilize the invention and various embodiments with modifications as are suited to particular use(s) contemplated. It is intended that the scope of the invention be defined by the claims appended hereto and their equivalents.

What is claimed is:

1. An LED driving circuit, comprising:

a) a rectifier circuit configured to receive an AC input power supply through a tri-electrode AC switch (TRIAC), and to generate a bus voltage;

b) a driving current generator configured to convert said bus voltage to a constant driving current and an output voltage to drive an LED load; and c) a current distribution circuit coupled between a positive pole and a negative pole of said bus voltage, wherein said current distribution circuit is configured to sample an input current to generate a sense signal, and to compare said sense signal against a voltage reference signal that represents an expected input current, so as to regulate said input current according to said voltage reference signal.

2. The LED driving circuit of claim 1, wherein said current distribution circuit comprises:

a) an operational amplifier configured to receive said sense signal and said voltage reference signal, and to generate a current control signal;

b) a sampling resistor, wherein said input current is sampled through said sampling resistor; and c) a power transistor controllable by said current control signal to control a current that flows through said power transistor, wherein said input current is maintained to be consistent with the voltage reference signal.

3. The LED driving circuit of claim 2, wherein said driving current generator is configured to sample the current that flows through said LED load, and to maintain an output current as substantially constant via feedback control.

4. The LED driving circuit of claim 2, wherein:

a) each half power frequency cycle comprises a TRIAC ignition time, a holding time, and a discharging time;

b) said voltage reference signal is consistent with a latching current of said TRIAC during said TRIAC ignition time;

c) said voltage reference signal is consistent with said holding current during said holding time; and d) said voltage reference signal is in consistent with said discharging current during said discharging time.

5. The LED driving circuit of claim 1, further comprising a bus voltage detector and an LED configuration controller, wherein said LED configuration controller is configured to turn on corresponding LED lights according to said bus voltage.

6. The LED driving circuit of claim 5, wherein said bus voltage detector comprises:

a) a comparator configured to compare said bus voltage against a threshold voltage, and to generate a conduction angle signal that represents the conduction angle of said TRIAC; and b) a frequency dividing circuit configured to generate a first clock signal that represents a positive half cycle of said conduction angle signal, and a second clock signal that represents a negative half cycle of said conduction angle signal, wherein said positive and negative half cycles of said conduction angle signal have a same duration.

7. The LED driving circuit of claim 6, wherein said output current of said driving current generator is regulated according to said conduction angle signal, by reducing said output current when said conduction angle is large, and increasing said output current when said conduction angle is small.

8. An LED driving circuit, comprising:

a) a rectifier circuit configured to receive an AC input power supply through a tri-electrode AC switch (TRIAC), and to generate a bus voltage;

b) a driving current generator configured to convert said bus voltage to a constant driving current and an output voltage to drive an LED load; and c) a current distribution circuit being coupled between a positive pole and a negative pole of said bus voltage, wherein said current distribution circuit is configured to sample a current flowing through said current distribution circuit to generate a sense signal, and to compare said sense signal against a voltage reference signal that represents an expected current flowing through said current distribution circuit, so as to regulate an input current according to said voltage reference signal.

9. The LED driving circuit of claim 8, wherein said current distribution circuit comprises:

a) an operational amplifier configured to receive said sense signal and said voltage reference signal, and to generate a current control signal;

b) a sampling resistor, wherein said current flowing through said current distribution circuit is sampled through said sampling resistor; and c) a power transistor controllable by said current control signal to control a current that flows through said power transistor, wherein said current flowing through said current distribution circuit is maintained to be consistent with the voltage reference signal.

* * * * *